US005899433A

United States Patent [19]

Kim et al.

[11] Patent Number: 5,899,433

[45] Date of Patent: May 4, 1999

[54] WASHING WATER SUPPLY CONTROL APPARATUS FOR DISH WASHING MACHINE

[75] Inventors: Joon Woo Kim, Seoul; Young Hwan Park, Kyungki-Do; Hae Yoong Chung, Kyungki-Do; Jae Won Chang, Kyungki-Do; Si Moon Jeon; Dae Yeong Han, both of Seoul, all of Rep. of Korea

[73] Assignee: LG Electronics, Rep. of Korea

[21] Appl. No.: 08/816,578

[22] Filed: Mar. 13, 1997

[30] Foreign Application Priority Data

| | | | |
|---|---|---|---|
| Mar. 16, 1996 | [KR] | Rep. of Korea | 96-7121 |
| Mar. 16, 1996 | [KR] | Rep. of Korea | 96-7122 |
| Mar. 16, 1996 | [KR] | Rep. of Korea | 96-7124 |

[51] Int. Cl.[6] ..... F16K 31/10

[52] U.S. Cl. ..... 251/30.01; 137/599; 137/901

[58] Field of Search ..... 137/110, 901, 137/599; 251/30.01, 25, 16, 18

[56] References Cited

U.S. PATENT DOCUMENTS

| | | | |
|---|---|---|---|
| 990,530 | 4/1911 | Dufty | 251/16 |
| 1,038,294 | 9/1912 | Chilton | 137/901 |
| 1,518,461 | 12/1924 | Smith | 137/901 |
| 3,549,117 | 12/1970 | Hanson | 251/30.01 |
| 4,040,441 | 8/1977 | Brown | 137/460 |
| 4,273,310 | 6/1981 | Ginzler | 137/901 |
| 4,503,887 | 3/1985 | Johnson | 251/30.01 |
| 5,037,062 | 8/1991 | Neuhaus | 137/901 |

FOREIGN PATENT DOCUMENTS

| | | | |
|---|---|---|---|
| 691108 | 5/1940 | Germany | 251/16 |

*Primary Examiner*—Denise L. Ferensic
*Assistant Examiner*—Ramyar Farid
*Attorney, Agent, or Firm*—Ostrolenk, Faber, Gerb & Soffen, LLP

[57] ABSTRACT

A washing water supply apparatus for a dish washing machine which is capable of concurrently supplying washing water to both upper and lower spray arms or selectively supplying the washing water to either the upper spray arm or the lower spray arm based on the washing amount of dishes. The apparatus includes a casing for guiding washing water in a washing water flow path in order to convert a part of the washing water flow into a cross-flow, an orifice tube for increasing the flowing speed of the washing water introduced into the casing and discharging the same, a valve ball for opening/closing an orifice of the orifice tube, and movable in the interior of the casing in accordance with a flow direction of the washing water, and an actuator having a moving member for moving the valve ball toward the orifice.

7 Claims, 12 Drawing Sheets

WASHING WATER SUPPLY CONTROL APPARATUS FOR DISH WASHING MACHINE

BACKGROUND OF THE INVENTION

1. Field of the Invention

The present invention relates to a washing water supply control apparatus for a dish washing machine, and in particular to an improved washing water supply control apparatus for a dish washing machine which is capable of concurrently supplying washing water to both upper and lower spray arms and selectively supplying the washing water to either the upper spray arm or the lower spray arm based on the washing amount of dishes.

2. Description of the Conventional Art

FIG. 1 is a cross-sectional view schematically illustrating a conventional dish washing machine.

As shown therein, in an upper portion of a housing 1, an upper rack 2 is disposed for receiving dishes to be washed, and an upper spray arm 3 is disposed below the upper rack 2 for spraying washing water to the dishes arranged in the upper rack 2.

A lower rack 4 is arranged below the upper spray arm 3 for receiving dishes therein. A lower spray arm 5 is disposed below the lower rack 4 for spraying washing water to the dishes arranged in the lower rack 4.

A washing water container 6 is disposed in a portion below the lower spray arm 5 for receiving washing water therein. A filter 7 is spacedly disposed in the washing water container 6 for filtering food debris which is formed during the dish washing, and a drainage pump 8 is attached to a lower portion of the washing water container 6 for draining the washing water therefrom to the outside.

A circulation pump 10 is disposed beside the washing water container 6 for introducing the washing water stored in the washing water container 6 through an introduction conduit 9 and supplying the washing water to the upper and lower spray arms 3 and 5, and upper and lower washing water conduits 11 and 11' are connected to the circulation pump 10 for guiding the pumped washing water to the upper spray arm 3 and the lower spray arm 5.

The operation of the conventional dish washing machine will now be explained.

First, in a state that the washing water is held in the washing water container 6, the circulation pump 10 is operated, and the washing water held in the washing water container 6 is introduced to the introduction conduit 9, and the thusly introduced washing water is pumped to flow to the upper and lower washing water conduits 11 and 11'.

The washing water introduced into the upper and lower spray arms 3 and 5 are sprayed through spray nozzles (not shown), for thus washing the dishes arranged in the upper and lower racks 2 and 4. Here, the upper and lower spray arms 3 and 5 are rotated in accordance with (i.e., in reaction to ) the spray direction of the spray nozzles.

Thereafter, the washing water after having washed the dishes is collected in the washing water container 6 through a washing water drainage path (not shown), and the filter 7 filters food debris from the collected washing water.

When the washing operation is finished, the operation of the circulation pump 10 is stopped, and the drainage pump 8 is operated, and then the drainage pump 8 discharges washing water and food debris to the outside.

However, when washing a small amount of dishes, in other words, when washing the dishes arranged in only one of the upper or lower racks, since both the upper and lower spray arms 3 and 5 are still operated, a large amount of washing water is needed, thus needlessly consuming the electric power.

SUMMARY OF THE INVENTION

Accordingly, it is an object of the present invention to provide a washing water supply apparatus for a dish washing machine which overcomes the aforementioned problem encountered in the conventional art.

It is another object of the present invention to provide an improved washing water supply apparatus for a dish washing machine which is capable of concurrently supplying washing water to both an upper and a lower spray arm or selectively supplying the washing water to either the upper spray arm or the lower spray arm based on the amount of dishes being washed.

To achieve the above objects, there is provided a washing water supply apparatus for a dish washing machine which includes a casing for guiding washing water in a washing water flow path therethrough and converting a part of a flow of the washing water flow into a cross-flow, an orifice tube provided at a portion of the casing for increasing the flowing speed of the washing water introduced into the casing and discharging the washing water therethrough, a valve ball for opening/closing an orifice of the orifice tube, said valve ball being movable in an interior of the casing in accordance with a flow direction of the washing water, and a moving member having a moving member for selectively allowing the valve ball to move toward the orifice and blocking movement of the valve ball toward the orifice.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
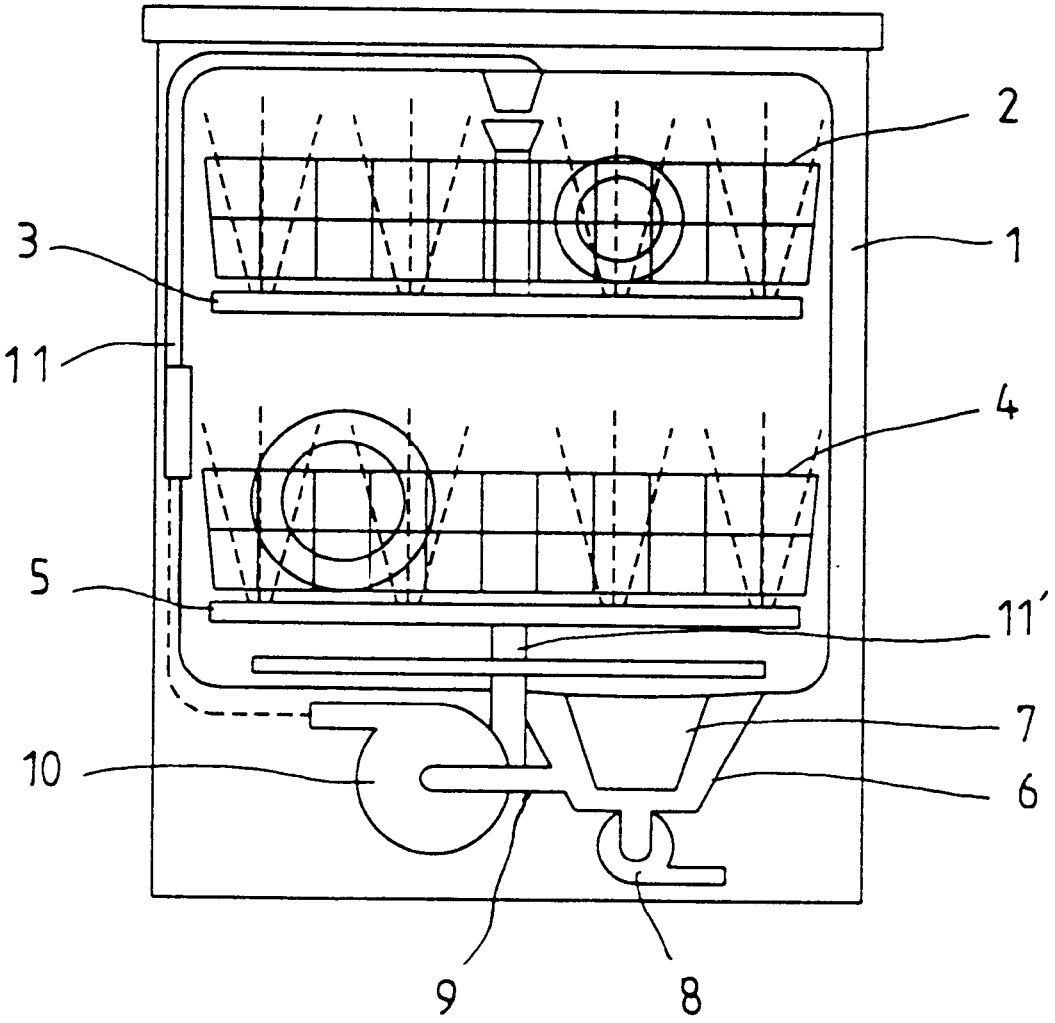
FIG. 1 CONVENTIONAL ART
FIG. 1 is a cross-sectional view illustrating a conventional dish washing machine.
Figure 2:
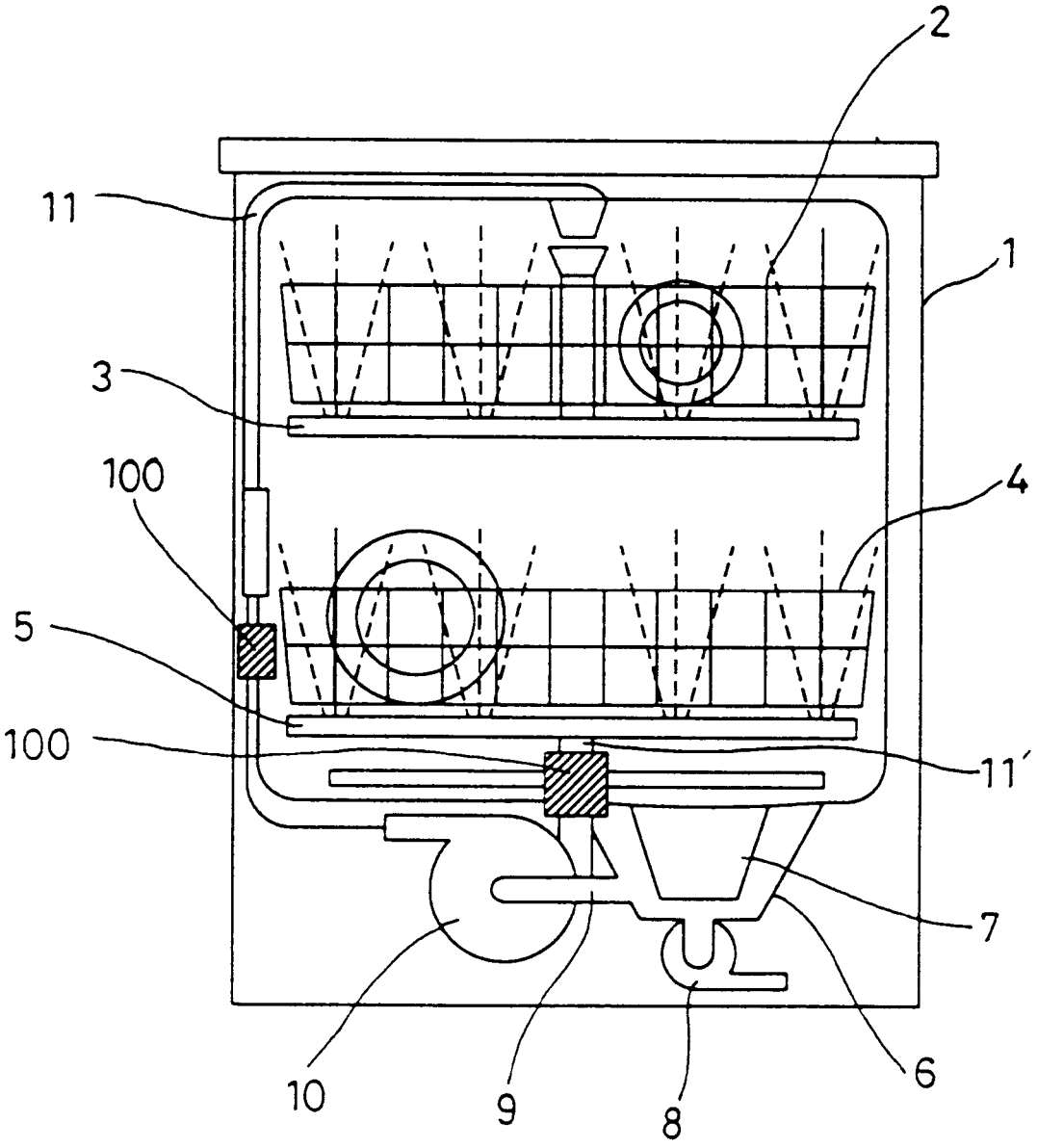
FIG. 2 is a cross-sectional view illustrating a dish washing machine having a washing water supply control apparatus according to the present invention.

FIG. 2 is a cross-sectional view illustrating a dish washing machine having a washing water supply control apparatus according to the present invention.

As shown therein, in an upper portion of a housing 1, an upper rack 2 is disposed for receiving dishes therein to be washed, and an upper spray arm 3 is disposed below the upper rack 2 for spraying washing water toward the dishes arranged in the upper rack 2.

A lower rack 4 is disposed below the upper spray arm 3 for receiving dishes to be washed, and a lower spray arm 5 is disposed below the lower rack 4 for spraying washing water toward the dishes arranged in the lower rack 4.

A washing water container 6 is disposed below the lower spray arm 5 for holding washing water therein. A filter 7 is spacedly disposed in the washing water container 6 for filtering food debris from the washing water, and a drainage pump 8 is disposed at a lower portion of the washing water container 6 for discharging the washing water to the outside.

A circulation pump 10 is disposed beside the washing water container 6 for introducing the washing water held in the washing water container 6 through an introduction conduit 9 and for pumping the same to the upper spray arm 3 and the lower spray arm 5, respectively. In addition, upper and lower washing water conduits 11 and 11' are connected to the circulation pump 10 for guiding the pumped water to the upper spray arm 3 and the lower spray arm 5, respectively.

In particular, a washing water supply control apparatus 100 is disposed in an intermediate portion of each of the upper and lower washing water conduits 11 and 11' for controlling the washing water supply to the upper and lower spray arms 3 and 5.

Figure 3A:
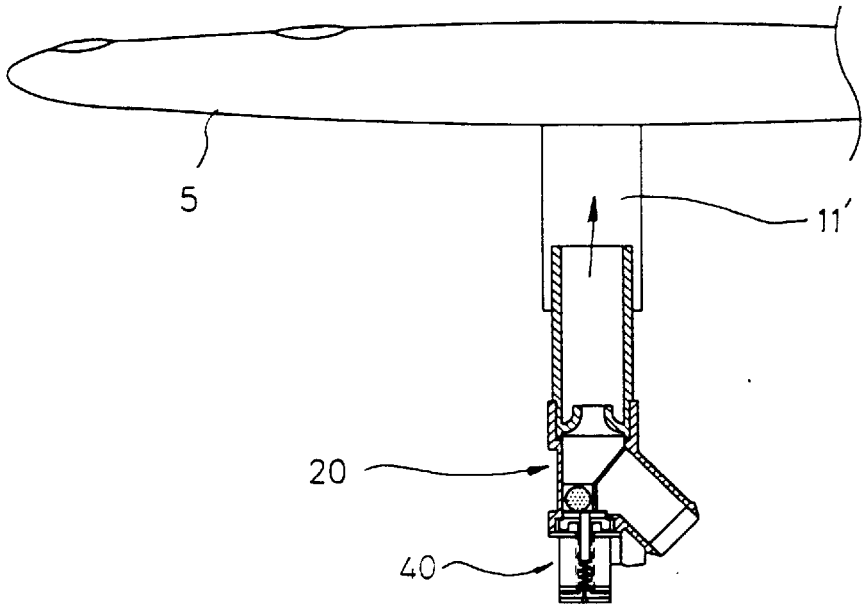
FIG. 3A is a cross-sectional view illustrating the washing water supply control apparatus attached to a lower washing water path according to a first embodiment of the present invention.
Figure 3B:
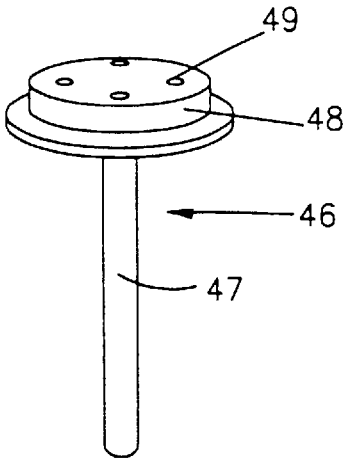
FIG. 3B is a perspective view illustrating a first moving member of the water supply control apparatus in FIG. 3A.
Figure 4A:
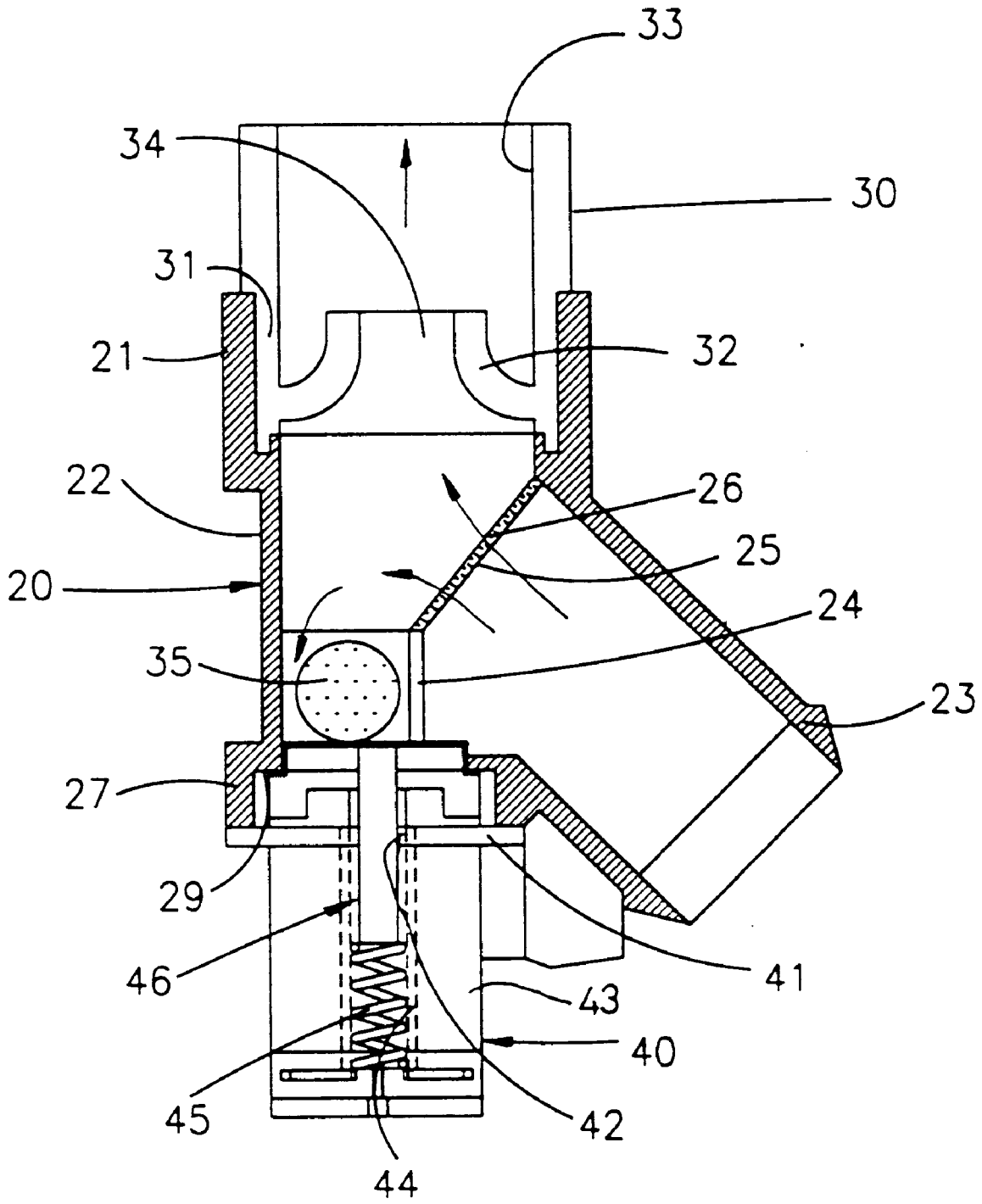
FIG. 4A is a cross-sectional view illustrating a state wherein the washing water supply control apparatus supplies washing water to a spray arm in FIG. 3A.
Figure 4B:
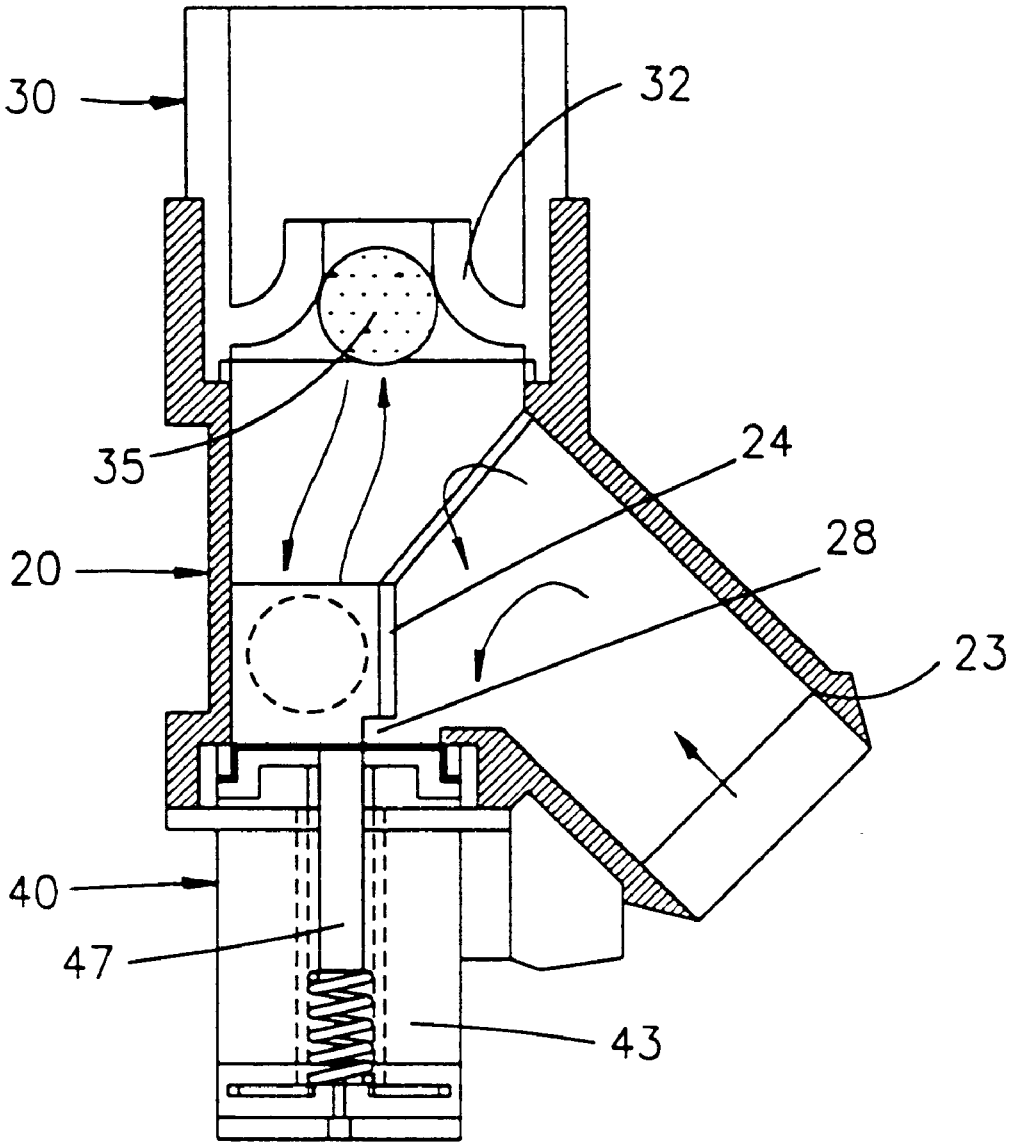
FIG. 4B is a cross-sectional view illustrating a state wherein the washing water supply apparatus blocks the washing water from being supplied to the spray arm in FIG. 3A.

FIG. 3A is a cross-sectional view illustrating the washing water supply control apparatus installed in the lower washing water conduit according to a first embodiment of the present invention. FIG. 3B is a perspective view illustrating a first moving member of the water supply control apparatus of FIG. 3A. FIG. 4A is a cross-sectional view illustrating the state wherein the washing water supply control apparatus supplies washing water to a lower spray arm in FIG. 3A, and FIG. 4B is a cross-sectional view illustrating the state wherein the washing water supply apparatus blocks the washing water from being supplied to the lower spray arm in FIG. 3A.

As shown therein, the washing water supply control apparatus 100 includes a casing 20 for guiding the washing water flowing in the lower washing water conduit 11' and changing a part of the washing water flow into a cross-flow, an orifice tube 30 having a discharge orifice 34 provided therein for increasing the flowing speed of the washing water from the casing 20 and for discharging the washing water to the following portion of the conduit 11', a ball 35 which is movable in the interior of the casing 20 in accordance with the flowing direction of the washing water for selectively blocking the orifice 34 of the orifice tube, and a moving unit 40 for moving the ball 35 to the orifice 34.

The construction of the casing 20 will now be explained in more detail.

The casing 20 includes an upper engaging portion 21 into which a lower portion of the orifice tube 30 is inserted, and a water flow portion 22 formed below the upper engaging portion 21, in a lower portion of which water flow portion 22 the washing water is cross-flowed. Here, the water flow portion 22 has a diameter smaller than the upper engaging portion 21.

A water inlet tube 23 is formed downwardly and inclinedly depending from the water flow portion 22 and first engaging portion 21 for introducing the washing water therethrough, and a cross-flow formation plate 24 is arranged in a lower portion of the water flow portion 22 for converting a part of the washing water flow from the inlet tube 23 into a cross-flow in a lower portion within the casing 20.

A mesh guide member 25 is inclinedly arranged in an upper end portion of the water inlet tube 23 for guiding the ball 35 to a cross-flow region defined by the cross-flow formation plate 24 and for introducing or discharging the washing water into/from the water inlet tube 23. Here, the mesh guide member 25 is preferably formed to be circular.

The mesh guide member 25 includes a plurality of washing water flow holes 26 each having a diameter smaller than that of the ball 35 in order to block the ball 35 from entering into the water inlet tube 23.

A lower engaging portion 27 is extended from a lower portion of the water flow portion 22 and has the same diameter as the upper engaging portion 21. An upper portion of the moving unit 40 is inserted into lower engaging portion 27. An introduction hole 28 is formed in a lower portion of the cross-flow formation plate 24 so that a part of the washing water being introduced through the water inlet tube 23 is guided toward a region below the cross-flow region within the casing 20.

Next, the construction of the orifice tube 30 will be explained in more detail.

The orifice tube 30 includes a lower engaging portion 31 inserted into the upper engaging portion 21 of the casing 20, an orifice formation portion 32 formed within the lower engaging portion 31 for forming the orifice 34 thereat, and a guide portion 33 formed above the orifice formation portion 32 for guiding the washing water discharged through the orifice 34.

The construction of the moving unit 40 and a moving member 46 thereof will now be explained in detail.

The moving unit has an upper engaging portion 41 which is fixed to a lower portion of the lower engaging portion 27 of the water flow portion, and a guide hole 42 is formed in the center of the upper engaging portion 41.

A solenoid 43 is disposed below the upper engaging portion 41, and a cylindrical guide hole 44 is formed in the center of the solenoid 43, with a spring 45 disposed in a lower portion of the guide hole 44.

Next, the construction of the moving member 46 will be explained in more detail with reference to FIG. 3B.

The lower end of a guide shaft 47, which is vertically movable along the guide hole 42 and the inner wall of the cylindrical guide hole 44, is engaged to an upper end of the spring 45.

A circular base plate 48, as shown in FIG. 3B, having a recess portion for being engaged with a shoulder portion formed in inner portion of the lower engaging portion 27 is fixed to the upper end of the guide shaft 47, and a plurality of water pressure control holes 49 are formed through the base plate 48 for maintaining a predetermined pressure on both sides of the base plate 48.

Figure 5A:
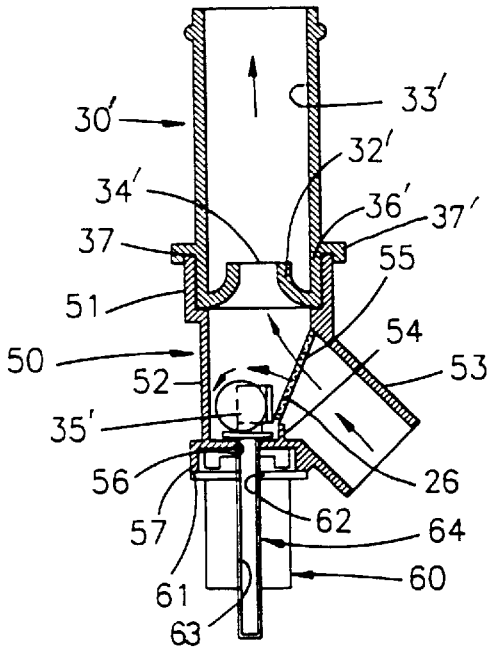
FIG. 5A is a cross-sectional view illustrating a washing water supply control apparatus according to a second embodiment of the present invention.
Figure 5B:
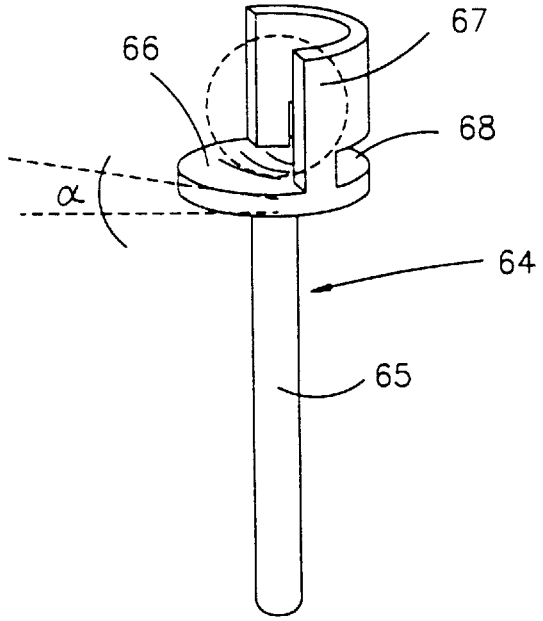
FIG. 5B is a perspective view illustrating a second moving member of the washing water supply control apparatus of FIG. 5A.
Figure 6A:
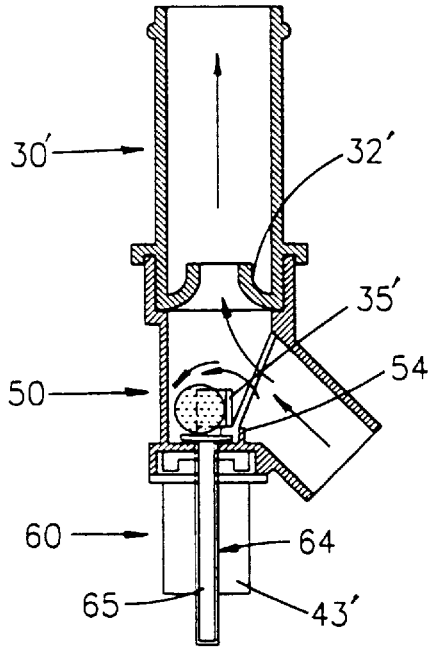
FIGS. 6A through 6C are cross-sectional views illustrating a washing water blocking sequence of the washing water supply control apparatus of FIG. 5A.
Figure 6B:
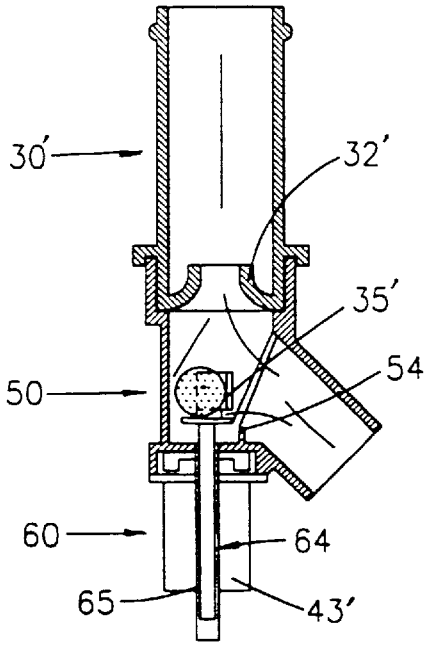
Figure 6C:
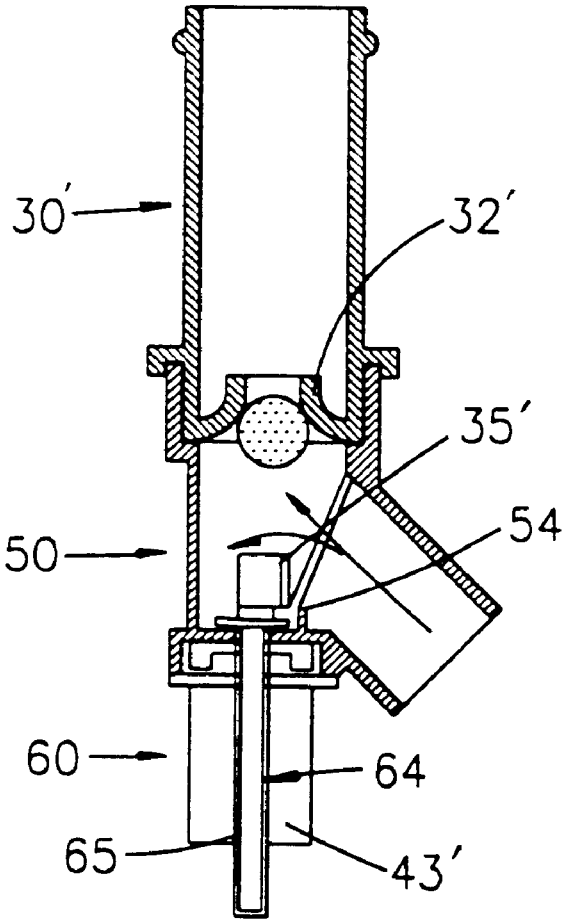

FIG. 5A is a cross-sectional view illustrating a washing water supply control apparatus according to a second embodiment of the present invention. FIG. 5B is a perspective view illustrating a moving member of the washing water supply control apparatus of FIG. 5A, and FIGS. 6A through 6C are cross-sectional views illustrating the washing water blocking sequence of the washing water supply control apparatus of FIG. 5A.

As shown therein, there are provided an orifice tube 30', a ball 35', a casing 50, a moving unit 60, and a moving member 64.

The construction of the casing 50 will now be explained in more detail.

The casing 50 includes an upper engaging portion 51, into which a lower portion of the orifice tube 30 is inserted, and a flow portion 52 integrally formed between the upper engaging portion 51. Here, the flow portion 52 has a diameter smaller than that of the upper engaging portion 51.

An inlet introduction tube 53 is downwardly extended and inclined with respect to the casing 50 and communicates with the washing water conduit 11 or 11' for introducing the washing water flowing therethrough, and a cross-flow formation plate 54 is disposed in a lower portion of a mesh guide member 55 for converting a part of the washing water flow from the inlet tube 53 into a cross-flow.

In particular, the cross-flow formation plate 54 is disposed at a portion which is not higher than an uppermost position of the moving member 64.

The circular mesh guide member 55 is disposed in an inner upper portion of the inlet tube 53 for guiding the ball 35 into a cross-flow region formed in a lower portion within the casing 50 by the cross-flow formation plate 54 and for introducing or discharging the washing water into/from the inlet tube 53.

A plurality of washing water flow holes 26 each having a diameter smaller than that of the ball 35 are formed in the mesh guide member 55 in order to prevent the ball 35 from entering into the inlet tube 53.

A guide hole 56 is formed in an inner lower portion of the flow portion 52, and a lower engaging portion 57 is integrally formed below the flow portion 52 into which lower engaging portion 57 the upper portion of the moving unit 60 is inserted.

The construction of the orifice tube 30' will now be explained in more detail.

The orifice tube 30' includes a lower engaging portion 36' which is inserted into the upper engaging portion 51 of the casing 50, and an upwardly extended orifice formation portion 32' is formed inside the lower engaging portion 36' for forming the orifice 34'.

A guide portion 33' is formed above the orifice formation portion 32' for guiding the washing water discharged rom the orifice 34' formed in the orifice formation portion 32, and a skirted engaging portion 37' is formed on an outer circumferential surface of the lower engaging portion 36' for receiving the upper portion of the upper engaging portion 51 of the casing 50 thereinto.

Next, the moving unit 60 having the moving member 64 will now be explained.

A matching upper engaging portion 61 is formed at the upper end of the moving unit 60 for being engaging with the lower engaging portion 57 of the casing 50, and a guide hole 62 is formed in the center of the upper engaging portion 61.

A solenoid 43' is disposed below the upper engaging portion 61, and a cylindrical guide hole 63 is formed in the center of the solenoid 43'.

The moving member 64 will now be explained with reference to FIG. 5B.

A guide shaft 65 forming the plunger of the solenoid is inserted into the guide hole 63 and the guide hole 62, respectively, in order for the guide shaft 65 to be movable therewithin, and a circular-shaped plate 66 is formed on the top end of the guide shaft 65 for being engaged with the lower surface of the flow portion 52, which plate 66 is being slanted at a predetermined angle $\alpha$ in the direction of the inlet tube 53.

An auxiliary cross-flow formation plate 67 is upwardly extended from an edge portion of one-half the upper surface edge portion of the slanted plate 66 in order to support the cross-flow formation.

An auxiliary slit 68 is formed in a boundary portion between the lower end of the cross-flow formation plate 67 and the slanted plate 66 for introducing the washing water which overflows from the cross-flow formation plate 54 when the guide shaft 65 is upwardly moved.

Figure 7:
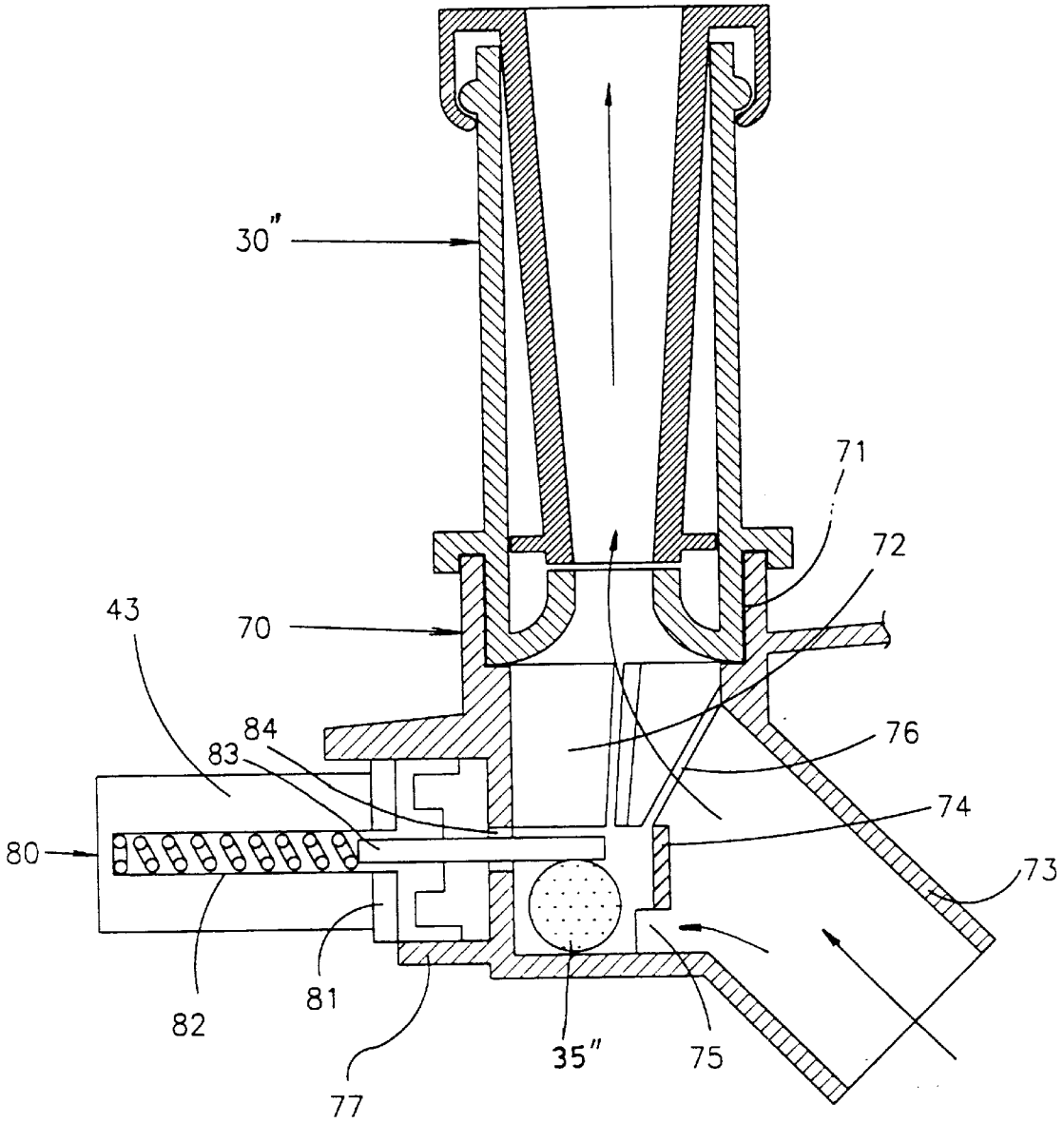
FIG. 7 is a cross-sectional view illustrating a washing water supply apparatus according to a third embodiment of the present invention.
Figure 8A:
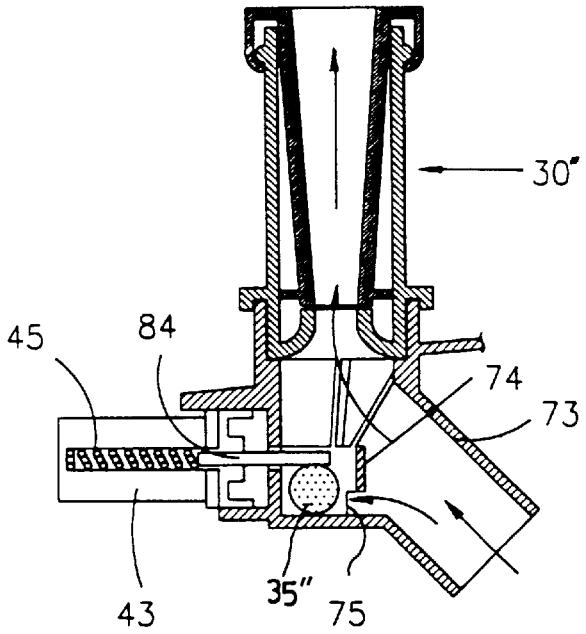
FIGS. 8A through 8D are cross-sectional views illustrating a washing water blocking sequence of the washing water supply control apparatus of FIG. 7.
Figure 8B:
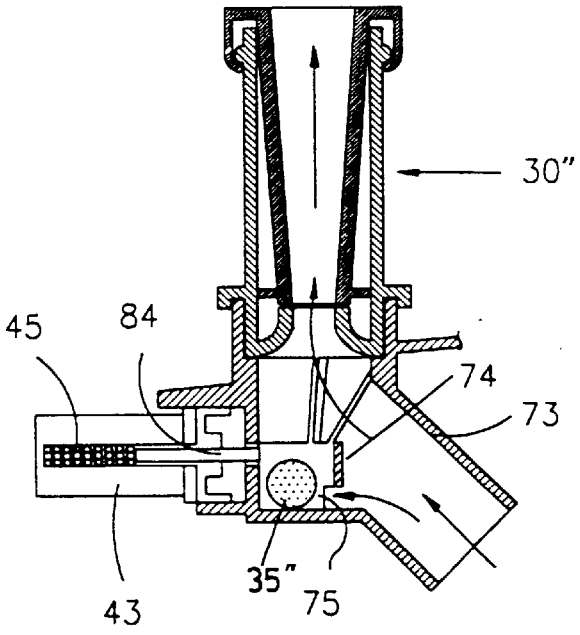
Figure 8C:
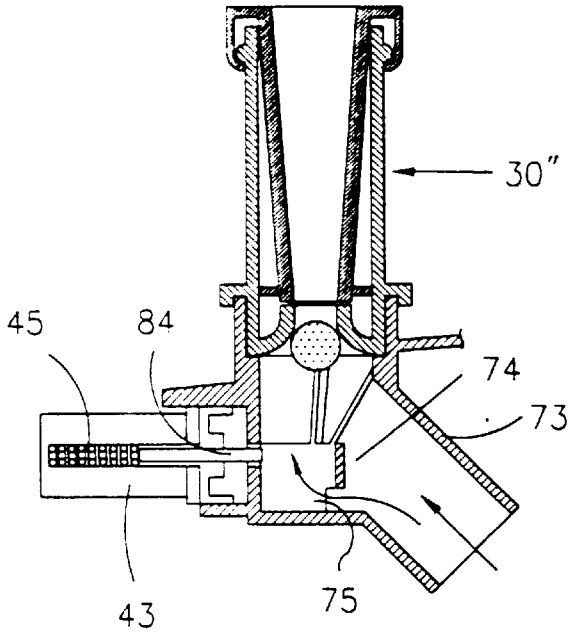
Figure 8D:
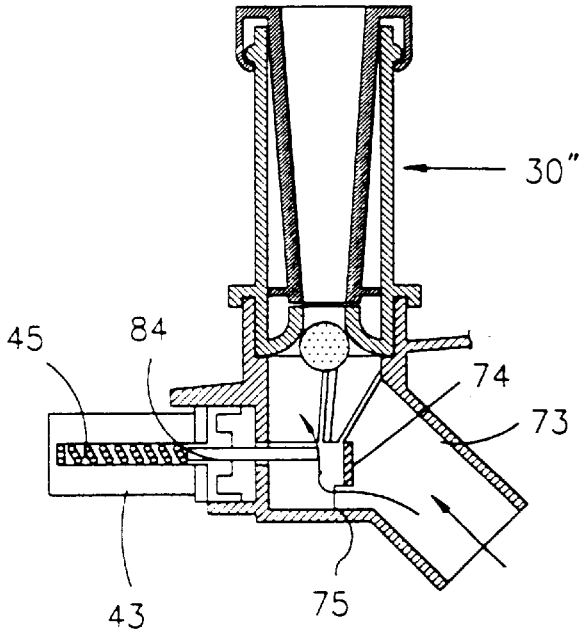

FIG. 7 is a cross-sectional view illustrating a washing water supply apparatus according to a third embodiment of the present invention, and FIGS. 8A through 8D are cross-sectional views illustrating a washing water blocking sequence by the washing water supply control apparatus of FIG. 7.

As shown therein, a moving unit 80 incudes a casing 70, an orifice tube 30", a ball 35", an a moving member 83.

The construction of the casing 70 will now be explained in more detail.

An upper engaging portion 71 is formed to be engaged with the orifice tube 30", and a flow portion 72 is formed below the upper engaging portion 71 and has a diameter less than that of the upper engaging portion 71.

An inlet tube 73 which communicates with the washing water conduit 11, 11', is downwardly extended from one side of the flow portion 72, and is inclined with respect to the orifice tube 30". A cross-flow formation plate 74 is disposed in an upper end portion of the inlet tube 73 for changing a part of the washing water flow into a cross-flow.

An introduction hole 75 is formed between the cross-flow formation plate 74 and the lower inner surface of the inlet tube 73 for introducing a predetermined amount of washing water introduced into the inlet tube 73 into a cross-flow region within the casing 70.

A circular plate-shaped mesh guide member 76 is disposed in an upper inner end portion of the inlet tube 73 for guiding the ball 35" into the cross-flow region formed by the cross-flow formation plate 74 and for passing the washing water introduced into and discharged from the inlet tube 73, and a tube-shaped lower engaging portion 77 is formed below the flow portion 72 for receiving the moving unit 80.

A plurality of washing water flow holes 26 are formed in the mesh guide member 76, and have a diameter smaller than that of the ball 35" in order to prevent the ball 35" from entering the inlet tube 73.

The orifice tube 30" has the same construction as a second embodiment of the present invention.

The construction of the moving unit 80 having the moving member 83 will now be explained.

A matching circular engaging portion 81 is disposed in an inner portion of the lower engaging portion 77 of the casing 70, and a solenoid 43 is disposed on one side of the matching engaging portion 81, and a cylindrical guide hole 82 is formed in the center of the solenoid 43.

One end of a spring 45 contacts with the closed end of the guide hole 82 and the guide hole 63, and a moving member 83 acting as the plunger of the solenoid 43 contacts with the other end of the spring 45. A guide hole 84 is formed in another side of the flow portion 72 aligned with the guide hole 82.

Figure 9:
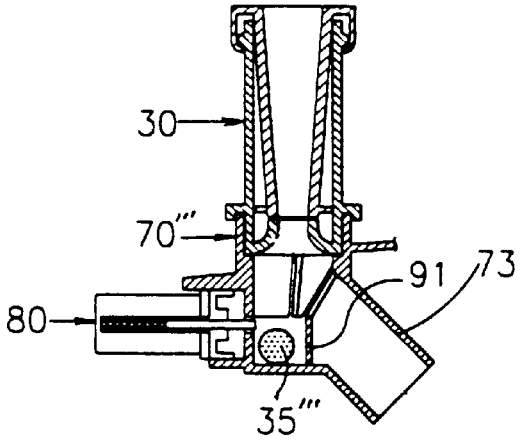
FIG. 9 is a cross-sectional view illustrating a washing water supply control apparatus according to a fourth embodiment of the present invention.

FIG. 9 is a cross-sectional view illustrating a washing water control apparatus according to a fourth embodiment of the present invention. Since, a shown therein, the construction of the fourth embodiment of the present invention is basically the same as the third embodiment of the present invention description thereof will be omitted except for the following different features.

A cross-flow formation plate 91 is formed below the casing 70' in order to guide a cross-flow of washing water for a ball 35" to b directed to an inner portion of the casing 70'".

The ball 35'" is made of a material having a density lower than that of the washing water.

Figure 10:
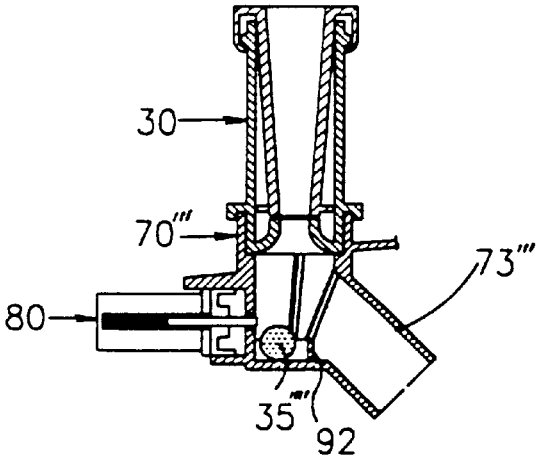
FIG. 10 is a cross-sectional view illustrating a washing water supply control apparatus according to a fifth embodiment of the present invention.

FIG. 10 is a cross-sectional view illustrating a washing water supply control apparatus according to a fifth embodiment of the present invention. Since, as shown therein, the construction of the fifth embodiment of the present invention is basically the same as the third embodiment of the present invention, detailed description thereof will be omitted except for the following different features.

A cross-flow formation plate 92 is formed a the bottom of the casing 70'" at the juncture of the inlet tube 73'" and has a height smaller than the diameter of the ball 35"".

The operation and effects of the washing water supply control apparatus 100 of the dish washing machine according to the present invention will now be explained with reference to the accompanying drawings.

First, the washing water is supplied to the washing water container 6, and then the washing water held in the washing water container 6 is introduced into the circulation pump 10 through an inlet conduit 9, and the thusly introduced washing water is pumped to flow along the upper and lower washing water conduits 11 and 11'.

Here, the washing water passes through the washing water supply control apparatus 100 disposed in each of the upper and lower washing water conduits 11 and 11' and is supplied to the upper and lower spray arms 3 and 5, respectively.

However, in a blocking mode operation of one of the two washing water supply control apparatuses, the washing water flows only through the other washing water supply apparatus operated in the supply mode.

Thereafter, the washing water introduced into the upper and lower spray arms 3 and 5 is sprayed through spray nozzles (not shown), and washes the dishes arranged in the upper and lower racks. The spray arms are rotated in accordance with (in reaction to) the spray directions of the spray nozzles.

The washing water after washing the dishes is drained back to the washing water container 6. At this time, the filter 7 filters food debris from the washing water.

When the dish washing operation is finished, the operation of the circulation pump 10 is stopped, and the drainage pump 8 is operated, for thus discharging the used washing water to the outside.

The operation of the washing water supply control apparatus 100 will now be explained in more detail.

First, the washing water supply mode according to the first embodiment of the present invention will be explained with reference to FIG. 4A.

When the washing water flowing through the upper and lower washing water paths 11 and 11' is introduced into the water inlet tube 23, a part of the thusly introduced washing water collides with the cross-flow formation plate 24, for thus forming a cross-flow of the washing water, whereby the cross-flow is formed at an inner portion of the cross-flow formation plate 24, and the remaining washing water passes through the orifice formation portion 32, and the flowing speed thereof is increased due to the reduced orifice cross-section when discharging the washing water through the orifice 34. In other words, the cross-flow formation plate is provided to the inner portion of the casing or to guide the washing water toward the lower portion of the bowl and in the orifice tube respectively.

Here, the base plate 48 of the moving member 46 contacts with the cross-flow formation plate 24 and an engaging shoulder portion 29 of the casing 20, for thus blocking the inlet hole 28, so that the ball 35 positioned in the cross-flow region is rotated in place, namely, the ball 35 is not directed to toward another position in the casing.

The blocking mode according to the first embodiment of the present invention will now be explained with reference to FIG. 4B.

When changing the operating mode from the supply mode to the blocking mode, the solenoid 43 is operated, for thus generating magnetic force for a short time. At this time, the guide shaft 47 of the moving member 46 is downwardly moved by the magnetic force, and is returned to its original position by the elastic force of the spring 45 when the solenoid is again deactivated.

The inlet hole 28 is instantly opened by the downward movement of the guide shaft 47, and the washing water is introduced into a lower portion of the cross-flow region through the inlet hole 28 and serves to push the valve ball 35 upwards.

Thereafter, the upwardly moved ball 35 contacts with the washing water flow near the orifice 34, for thus closing the orifice 34.

The ball 35 which is blocking the orifice 34 keeps the blocked state by the pressure of the washing water introduced through the water inlet tube 23.

When the washing operation is completed, and the circulation pump 10 is stopped, the ball 35 is moved downwards toward the mesh guide member 25 by the reverse draining flow of the washing water remaining in the upper and lower spray arms 3 and 5. Since the ball 35 reaching the mesh guide member 25 has a diameter larger than the washing water flow holes 26, the ball 35 can not be moved toward the water inlet tube 23. Therefore, the ball 35 collides with the mesh guide member 25 and is moved toward the inner portion of the casing behind the cross-flow formation plate 24.

Next, the supply mode according to the second embodiment of the present invention will now be explained with reference to FIG. 5A.

When the washing water flowing along the upper and lower washing water conduits 11 and 11' is introduced through the inlet tube 53, a part of the flow of the thusly introduced washing water collides with the cross-flow formation plate 54 and the auxiliary cross-flow formation plate 67 of the moving member 64 and is changed into a cross-flow. The thusly created cross-flow forms a cross-flow region behind the auxiliary cross-flow formation plate 67, and the remaining washing water flow passes through the orifice formation portion 32, wherein the flowing speed of the washing water is increased as the flow passes the orifice, and the washing water is discharged from the orifice 34.

Here, since the auxiliary slit 68 of the moving member 64 contacts with the cross-flow formation plate 54, the washing water is not moved into the cross-flow formation region, and the ball 35 being positioned in the cross-flow region is rotated in place, namely, the ball 35 is not moved upwardly toward the orifice.

The blocking mode according to the second embodiment of the present invention will now be explained with reference to FIG. 6.

When changing the mode from the supply mode to the blocking mode, the solenoid 43 is operated, and magnetic force is generated for a short time. At this time, the guide shaft 65 of the moving member 64 is instantly and upwardly moved by the magnetic force.

As the guide shaft 65 is upwardly moved, the washing water introduced through the inlet tube 53 is introduced through the auxiliary slit 68 and servers to upwardly push the ball 35 positioned in the cross-flow region.

Thereafter, the upwardly moved ball 35 contacts with the washing water near the orifice 34, for thus blocking the orifice 34.

The ball 35 which is blocking the orifice 34 maintains a blocked state due to the pressure of the washing water introduced through the inlet tube 53.

When the circulation pump 10 is stopped, the ball 35 collides with the mesh guide member 55 and returns to its initial position.

Next, the supply mode according to the third embodiment of the present invention will now be explained with reference to FIG. 7.

When the washing water flowing along the upper and lower washing water conduits 11 and 11' is introduced through the inlet tube 73, a part of the thusly introduced washing water flow collides with the cross-flow formation plate 74 and is converted into a cross-flow, and a cross-flow region is formed behind the cross-flow formation plate 74, and the washing water introduced through inlet hole 75 is mixed in the cross-flow region and flows along a predetermined path. The remaining washing water passes through the orifice formation portion 32, wherein the flowing speed thereof is increased, for thus discharging the washing water through the orifice 34.

The moving member 83 prevents the ball 35 from being moved toward the orifice 34 (FIG. 8A), so that the washing water flows toward the spray arms 3 and 5.

The blocking mode according to the third embodiment according to the present invention will now be explained with reference to FIGS. 8A through 8D.

When changing the mode from the supply mode to the blocking mode, the solenoid 43 is operated, for thus generating magnetic force for a short time. At this time, the moving member 83 is horizontally moved (retracted) toward the guide hole 82 through the guide hole 84 by the magnetic force and is then returned to its original extended position by the elastic force of the spring 45.

As the moving member 83 is retracted inwardly by the magnetic force (FIG. 8B), the ball 35 which was being blocked by the moving member is upwardly moved by the pressure of the washing water introduced through the inlet hole 75(FIG. 8C), and the thusly upwardly moved ball 35 contacts with the washing water near the orifice 34, for thus blocking the orifice 34.

The ball 35 which is blocking the orifice 34 maintains the blocked state by the pressure of the washing water introduced through the inlet tube 73.

Thereafter, when the circulation pump 10 is stopped, the ball 35 collides with the mesh guide member 76 and is placed atop the moving member 83.

Thereafter, when the solenoid is operated and the moving member 83 is again retracted, the ball 35 is returned to its original position.

Next, the washing water supply control apparatus for a dish washing machine according to the fourth embodiment of the present invention will now be explained with reference to FIG. 9.

When the washing water flowing along the upper and lower washing water conduits 11 and 11' is introduced through the inlet tube 73, a part of the thusly introduced washing water flow collides with the cross-flow formation plate 91 and is converted into a cross-flow, for thus forming a cross-flow region behind the cross-flow formation plate 91, and the remaining washing water flow passes through the orifice formation portion 32''', wherein the flowing speed thereof is increased, and the washing water is discharged through the orifice 34'''.

At this time, the moving member 83 blocks the ball 35''' from being be moved toward the orifice 34''', whereby the washing water flows toward the spray arms 3 and 5.

In addition, when changing the mode from the supply mode to the blocking mode, the solenoid 43 is operated, for thus generating magnetic force for a short time. At this time, the moving member 83 is horizontally moved (retracted) toward the guide hole 82 through the guide hole 84 and when the solenoid is deenergized the member 83 is returned to its original position by the elastic force of the spring 45.

When the moving member 83 is horizontally retracted by the magnetic force, the ball 35'''' which was being blocked by the moving member 83 is upwardly moved because the ball 35' is made of a material having a density less than the washing water. The upwardly moved ball 35' contacts with the flow of the washing water near the orifice 34, for thus blocking the orifice 34.

Thereafter, the ball 35' which is blocking the orifice 34 maintains the blocked state by the pressure of the washing water introduced through the inlet tube 73''.

Next, the washing water supply control apparatus for a dish washing machine according to the fifth embodiment of the present invention will now be explained with reference to FIG. 10.

When the washing water flowing along the upper and lower washing water conduits 11 and 11' is introduced through the introduction tube 73, a part of the washing water flow collides with the cross-flow formation plate 92 and is converted into a cross-flow, for thus forming a cross-flow region behind the cross-flow formation plate 92. The washing water passes through the orifice formation portion 32, wherein the flowing speed thereof is increased, and the washing water is discharged through the orifice 34.

At this time, since the moving member 83 prevents the ball 35 from being moved toward the orifice 34, the washing water flows toward the spray arms 3 and 5, respectively.

When changing the mode from the supply mode to the blocking mode, the solenoid 43 is operated briefly, for thus generating magnetic force for a short time. At this time, the moving member 83 is instantly and horizontally moved (retracted) toward the guide hole 82 through the guide hole 84 by the magnetic force and then is returned to its original position by the elastic force of the spring 45 when the solenoid is deenergized.

Here, the height of the cross-flow formation plate 92 is smaller than the diameter of the ball 35, and the cross-flow in the cross-flow region formed by the cross-flow formation plate 92 has a weaker flowing strength than that of the normally flowing washing water. Therefore, the ball 35 which was being blocked by the moving member 83 is upwardly moved, for thus blocking the orifice 34.

As described above, the washing water supply control apparatus for a dish washing machine according to the present invention is capable of selectively supplying the washing water to the upper and lower spray arms, for thus reducing the consumption of washing water and electric power, whereby it is possible to enhance the efficiency of the dish washing machine when washing only a small load of dishes.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A washing water supply control apparatus for a dish washing machine, comprising:

a casing guiding washing water in a washing water flow path to an orifice tube;

a water inlet tube formed in the casing for receiving the washing water;

a cross-flow formation plate provided at an inner portion of the casing for guiding the washing water to a cross flow region where a valve ball is located and to the orifice tube respectively;

an inlet hole formed between a lower portion of the cross-flow formation plate and an inner end portion of the water inlet tube;

the orifice tube provided in the casing for increasing the flowing speed of the washing water introduced into the casing and for discharging the washing water therethrough;

the valve ball for opening and closing an orifice of the orifice tube, the valve ball being movable in an interior of the casing in accordance with a flow direction of the washing water; and a moving means having a moving member for selectively opening and closing the inlet hole, wherein a closed position the valve ball sits freely on the moving member radially outward from the inlet hole and the moving means closes the inlet hole by engaging the lower portion of the cross-flow formation plate and the inner end portion of the water inlet tube in order to inhibit movement of the valve ball toward the orifice, and wherein in an open position the moving means disengages the lower portion of the cross-flow formation plate in order for a part of the washing water to be diverted to the cross-flow region allowing the valve ball to move toward the orifice, an inlet hold formed between a lower portion of the cross-flow formation plate and an inner end portion of the water inlet tube in order for a part of the washing water flow introduced thereinto through the water inlet tube to be guided to the cross-flow region within the casing.

2. The apparatus of claim 1, wherein said orifice tube includes:

an engaging portion formed in a tube shape in order to be engaged to an inner portion of the upper engaging portion of the casing;

an orifice formation portion which is bent inwardly to form an orifice above the engaging portion; and a guide portion formed above the orifice formation portion for guiding the washing water discharged through the orifice.

3. The apparatus of claim 1, wherein the moving means includes:

an engaging portion formed in a circular plate shape and engaged to a lower engaging portion of the casing;

a first guide hole formed in a center of the engaging portion;

a solenoid attached to a lower portion of the engaging portion;

a second guide hole formed in a cylindrical bar shape in a center of the solenoid; and a spring, one end of which is attached to an end surface of the second guide hole.

4. The apparatus of claim 3, wherein the moving member comprises a guide shaft having one end engaged to another end of the spring in order for the guide shaft to be vertically movable within the first guide hole and the second guide hole, and a circular base plate having step portions in a rim thereof for being engaged with an engaging shoulder portion formed in an inner portion of the lower engaging portion of the casing, the moving member having a plurality of water pressure control holes formed therethrough for constantly controlling the pressure of the washing water above and below the circular base plate.

5. The apparatus of claim 1, wherein the casing comprises:

an upper engaging portion formed in a tube shape in order for the orifice tube to be engaged thereto;

a flow portion having a diameter which is smaller than that of the upper engaging portion in order for the washing water to smoothly flow therethrough toward a lower portion of the upper engaging portion;

a mesh guide member disposed at an upper end portion of the water inlet tube for guiding the valve ball to the cross-flow region formed by the cross-flow formation plate and introducing and discharging the washing water into and from the water inlet tube; and a lower engaging portion extended from a lower portion of the flow portion in order for the moving means to be attached thereto, the lower engaging portion being tube-shaped with the same diameter as the upper engaging portion.

6. The apparatus of claim 5, wherein said mesh guide member includes a plurality of washing water flowing holes a diameter of each of which is smaller than a diameter of the valve ball.

7. The apparatus of claim 1, wherein the moving means includes:

an engaging portion formed in a circular plate shape and engaged to a lower engaging portion of the casing;

a first guide hole formed in a center of the engaging portion;

a solenoid attached to the engaging portion; and a second guide hole formed in a cylindrical shape in a center of the solenoid.

* * * * *